US007225947B2

(12) United States Patent
Leuenberger et al.

(10) Patent No.: US 7,225,947 B2
(45) Date of Patent: Jun. 5, 2007

(54) POURING SPOUT SEAL FOR COMPOSITE PACKAGINGS

(75) Inventors: Markus Leuenberger, Thayingen (CH); Jochen Kraus, Singen-Hohentwiel (DE)

(73) Assignee: SIG Technology Ltd., Neuhausen am Rheinfall (CH)

( * ) Notice: Subject to any disclaimer, the term of this patent is extended or adjusted under 35 U.S.C. 154(b) by 95 days.

(21) Appl. No.: 10/533,472

(22) PCT Filed: Oct. 24, 2003

(86) PCT No.: PCT/CH03/00695

§ 371 (c)(1),
(2), (4) Date: Jun. 27, 2005

(87) PCT Pub. No.: WO2004/039684

PCT Pub. Date: May 13, 2004

(65) Prior Publication Data

US 2005/0242112 A1 Nov. 3, 2005

(30) Foreign Application Priority Data

Oct. 29, 2002 (CH) ..... 1816/02

(51) Int. Cl.
*B67D 5/00* (2006.01)

(52) U.S. Cl. ..... 222/83; 222/541.1; 222/541.6; 222/556; 220/267; 220/837; 229/125.14

(58) Field of Classification Search ..... 222/83, 222/83.5, 80–81, 541.1, 566, 541.2, 541.6, 222/556–557; 220/836–837, 266–267; 229/125.14, 229/125.15
See application file for complete search history.

(56) References Cited

U.S. PATENT DOCUMENTS 4,930,683 A * 6/1990 Farber ..... 229/125.09
5,101,999 A * 4/1992 Robichaud et al. ..... 220/258.4
5,287,983 A 2/1994 Reil et al.
5,947,316 A * 9/1999 Guillonnet ..... 220/269

(Continued)

FOREIGN PATENT DOCUMENTS

DE 196 35 088 A1 3/1998

(Continued)

*Primary Examiner*—Frederick C. Nicolas
(74) *Attorney, Agent, or Firm*—Edwin D. Schindler

(57) ABSTRACT

The spout seal for combipacks consists of a bottom part (2) and a hinged lid (1) attached to it for opening and closing the seal. The bottom part (2) is fused onto a combipack with its level bottom side. It has a circular, upward-projecting overhang (11), which forms a pouring spout. The inside of the overhang (11) is open. The lid (1) forms a mold (21) that bulges out upwards on it when swiveled open, which forms a level top side that form-fits into the clearance opening (9) surrounded by the projecting lip (11) in the bottom side of the bottom part (2) when swiveled shut. This level top side either lies flush with this bottom side of the bottom part (2) or projects downward from this bottom side by up to 0.5 mm. This top side of the bulge (21) is bonded with the punched-out spot in the combipack or fused with the sealing foil of a combipack exposed through punching. When swiveling the lid (1) open, the sealing foil is cleanly torn out in the entire clearance section of the bottom part (2).

9 Claims, 6 Drawing Sheets

Figure 1:
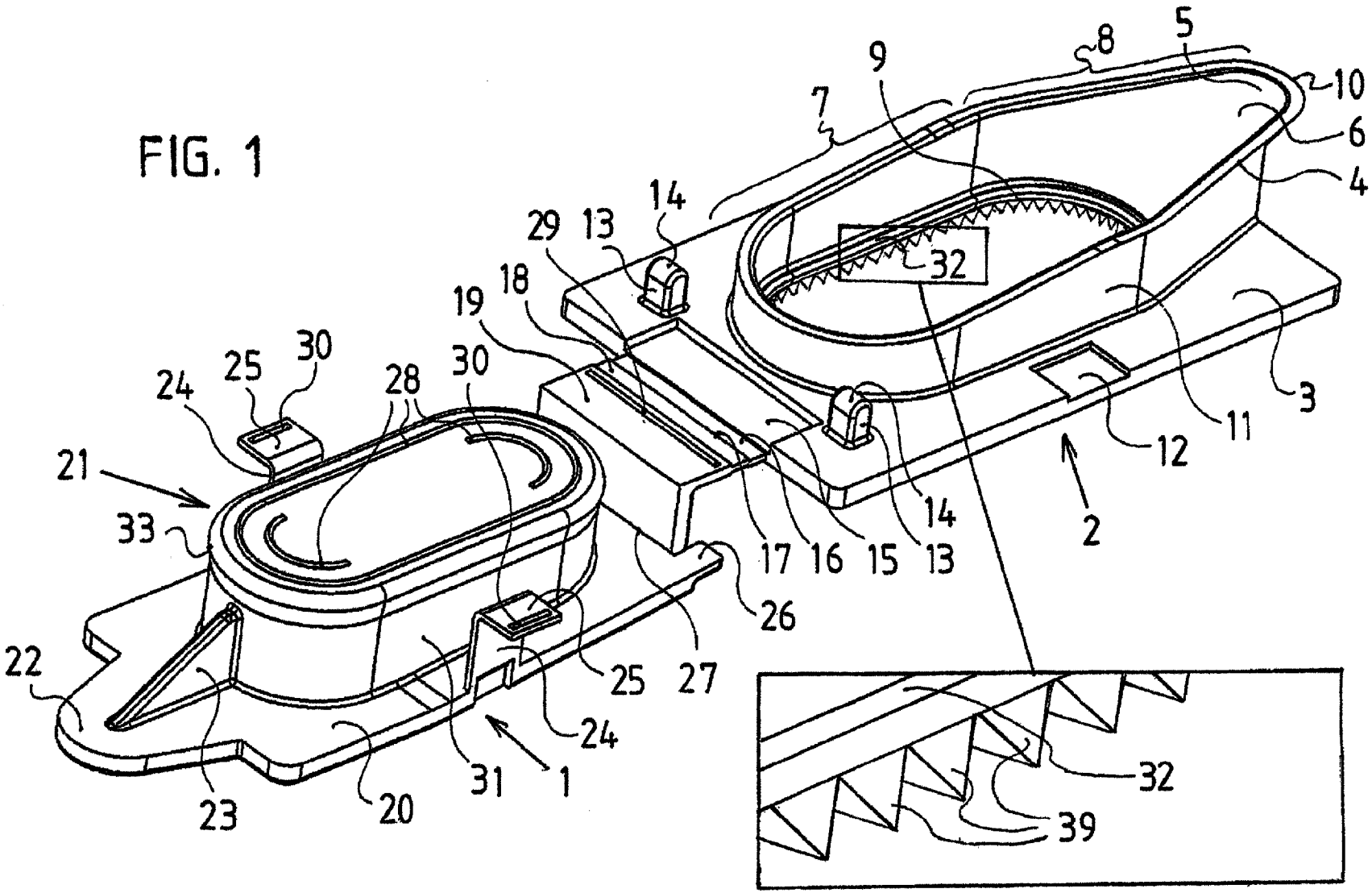

U.S. PATENT DOCUMENTS 6,041,968 A * 3/2000 Weiteder ..... 222/83
6,216,945 B1 * 4/2001 Gabrielli et al. ..... 229/204
6,257,449 B1 * 7/2001 Baerenwald ..... 222/83
6,279,769 B1 * 8/2001 Duvander et al. ..... 220/269
6,354,467 B1 * 3/2002 Mabee ..... 222/83
6,685,055 B2 * 2/2004 Taylor ..... 222/83
7,028,863 B1 * 4/2006 Taylor ..... 222/83

FOREIGN PATENT DOCUMENTS

EP 0291112 A2 11/1988
EP 0658480 A1 6/1995
FR 2738552 A1 3/1997
JP 08-119265 5/1996

* cited by examiner

POURING SPOUT SEAL FOR COMPOSITE PACKAGINGS

BACKGROUND OF THE INVENTION

1. Technical Field of the Invention

The present invention relates to a spout seal for combipacks. These are mainly intended for packs in the shape of such combipacks made of foil-coated paper containing liquids, for example milk, fruit juices, various kinds of non-alcoholic beverages or generally liquids also in the non-food sector. However, the seal may also be used for combipacks containing free-flowing goods such as sugar, semolina, or various kinds of chemicals. The foil-coated paper consists of a laminate material, for example of a paper or carton layer coated with a plastic material, for example polyethylene, and/or aluminum. The common volumes of such packs range from 20 cl up to 2 liters and more. A hole is punched out of the combipack at the position of the clearance opening of the seal to be fused on, which matches the clearance opening of the seal, which is subsequently sealed with a sealing foil.

2. Description of the Prior Art

There are various designs of spout seals made of plastic to be fused onto combipacks prepared in such a way. They form a bottom part, which is fused onto the combipack and a swivel lid piece attached thereto with a hinge. The bottom part has a circular lip that projects upwards around the clearance opening of the seal. This lip forms a spout at the front side of this bottom part. The lid hinged to the back of the bottom part has a downward-bulging shape. When the lid is closed, this fits into the inside of the lip of the bottom part and snaps into place there so that the spout is sealed. Upon first opening, and thus swinging the lid open for the first time, the sealing foil, which is located beneath the bottom part and covers the punched-out hole in the combipack, becomes visible on the inside of the upward-projecting lip of the bottom part. Outside the hole, the bottom part of the spout seal is fused onto the combipack with its plane bottom side. This means that, by default, the combipack is punched out in the place where the inside of the lip of the bottom part of the seal lies, and a sealing foil covers this section. The sealing foil may consist of an aluminum foil, which is glued together with the carton layer of the pack on the inside of the combipack. However, it may also consist of a PE coating, which is fused onto the inside of the carton material of the pack by means of high-frequency welding so that it covers the punched-out section onto which the spout seal is fused at a later stage. When the seal is opened for the first time by swinging its lid open, the sealing foil—an aluminum or a PE foil—becomes visible on the inside of the upward-projecting lip of the bottom part of the seal. The user then punches this foil in with a finger, which subsequently allows pouring out the content of the combipack through the spout formed by the protruding lip via its spout shape at the front.

The prior art includes European Patent Application No. 0,658,480 (Tetra Laval Holdings & Finance), which describes a seal having a small shoulder, at the bottom of the lid, which lifts an opening strip when the seal is swiveled open. The connection between this shoulder and the open strip then tears off and the opening strip, which seals the prepunched hole, can be manually torn off. This strip, however, has to be separately torn off and does not tear when the lid is swiveled open. French Patent No. 2,738,552 (Rical SA) shows a seal with a similar structure, whereby a sealing foil covers its clearance opening. This foil is part of the seal itself and is connected to it in one piece. When the lid is opened, this foil is torn out of the bottom part. Consequently, the lid does not tear out a sealing foil on the packaging material itself. Japan Patent Application 08-119265, Patent Abstracts of Japan, Vol. 1996, No. 09 (Shikoku Kakoki Co. Ltd.), discloses a seal similar to those in the above-mentioned prior art.

These conventional spout seals have several disadvantages. First of all, the pouring spout of the seals often does not have a very advantageous shape so that liquid runs down on the outside of the spout and down the combipack after pouring due to capillary effects. This spilling of the spout is very annoying, because often the entire front side of the combipack becomes soiled. In addition, another disadvantage of conventional solutions is that the seal has to be opened separately with a finger by pressing in the sealing foil after initially swinging the lid open. However, this method of opening the sealing foil is unhygienic. Moreover, the sealing foil is often not cleanly and entirely removed from the clear space inside the projecting lip. On the contrary, the sealing foil is torn open somewhere in its center section and then not properly pressed downwards into the inside of the combipack. This results in frayed edges on both sides, which protrude into the inside of the combipack and hamper and limit the free and clean flow of the content when pouring. If the combipack is tilted too much into the pouring direction, the mostly too small dimensions of the opening of the bottom part do not let enough air flow into the inside of the combipack. This leads to unwanted bubbling, meaning unsteady pouring in surges, which impedes targeted dosing into a glass or cup. In addition, the lid of many conventional seals is not reliably supported when the lid is open so that the lid slowly swings shut again due to material tension in the hinge section and hampers the pouring flow, unless one purposely keeps the lid part open with one hand, which is tedious. In many cases, one hand is needed to hold the combipack and pour while the other holds a glass, for example, into which the content is to be poured. This does not leave one hand free to hold the lid open. In addition, conventional spout seals have few user-friendly guarantee features, which are supposed to guarantee the initial opening, i.e. the initial swinging up of the seal top. With some solutions, a guarantee tape has to be tom off, which has to be grabbed with two fingers. This is often difficult in practice. For example, when the user has applied hand cream or sunscreen, it will be difficult for him to tear off the guarantee tape as long as his hands are greasy. Opening the seal with gloves is even less possible. And finally, re-closing is also not satisfactory because the seals are not sufficiently tight after closing the lid.

SUMMARY OF THE INVENTION

Therefore, these problems need to be resolved and a spout seal must be designed for combipacks that firstly enables the absolutely hygienic, clean and complete removal of the sealing foil covering the clearance width of the spout, and which afterwards enables bubble-free and continuous pouring with a thicker jet of liquid. Secondly, the spout seal should also have a safe initial opening guarantee in a special embodiment, while still allowing easy initial opening of the seal. In a special embodiment, it is also supposed to ensure that the lid is supported reliably and kept in its open or closed position. In another special embodiment, it is also supposed to ensure pouring without sucking the pouring stream on the outside of the pouring spout. Finally, it shall enable tight re-closing after use.

The foregoing and related problems are solved, and objects achieved, by a spout seal for combipacks having a bottom part, which is intended to be fused onto a combipack with its level bottom side, and a circular, upwardly-projecting overhang which forms a pouring spout, with the overhang's inner side being open, and with a lid being molded onto the bottom part for swiveling upwardly via a hinge and downwardly onto the bottom part for sealing. The lid forms a mold bulging upwards, when open, which forms a level upper surface and which form-fits into a clearance opening in the bottom side of the bottom part, surrounded by the projecting lip, when the lid is closed and is flush with this bottom side or when the lid projects downwards therefrom by up to 0.5 mm. The lid is connected via a film hinge to an L-shaped, moving-along swivel elbow by which the lid is connected to the bottom part via an additional film hinge, so that first leg of the L-shaped swivel elbow, which faces the bottom part, can be fused with a disk forming the bottom side of the bottom part when swiveled shut for the first time. The edge of the other leg, or second leg, of the L-shaped swivel elbow forms the swivel axis for swiveling the lid onto, and off of, the bottom part. Contrary to seals currently known to the prior art, the seal of the present invention can be fused onto a pack and offers a clearly visible initial opening guarantee. In addition, the lid of the invention is securely retained in an open position due to its geometry with the L-shaped swivel elbow.

The other, secondary functions are fulfilled by special embodiments of the pouring spout seal, which are described in the related patent claims.

BRIEF DESCRIPTION OF THE DRAWING FIGURES

The figures show different view of an advantageous embodiment of this the pouring spout seal for combipacks of the present invention, which fulfills all required functions. By means of these figures, the pouring spout seal is described in detail in the following section and its function described and explained.

FIG. 1: Shows the open spout lid in a perspective projection with the lid in the Front and the pertinent part behind the lid.

Figure 2:
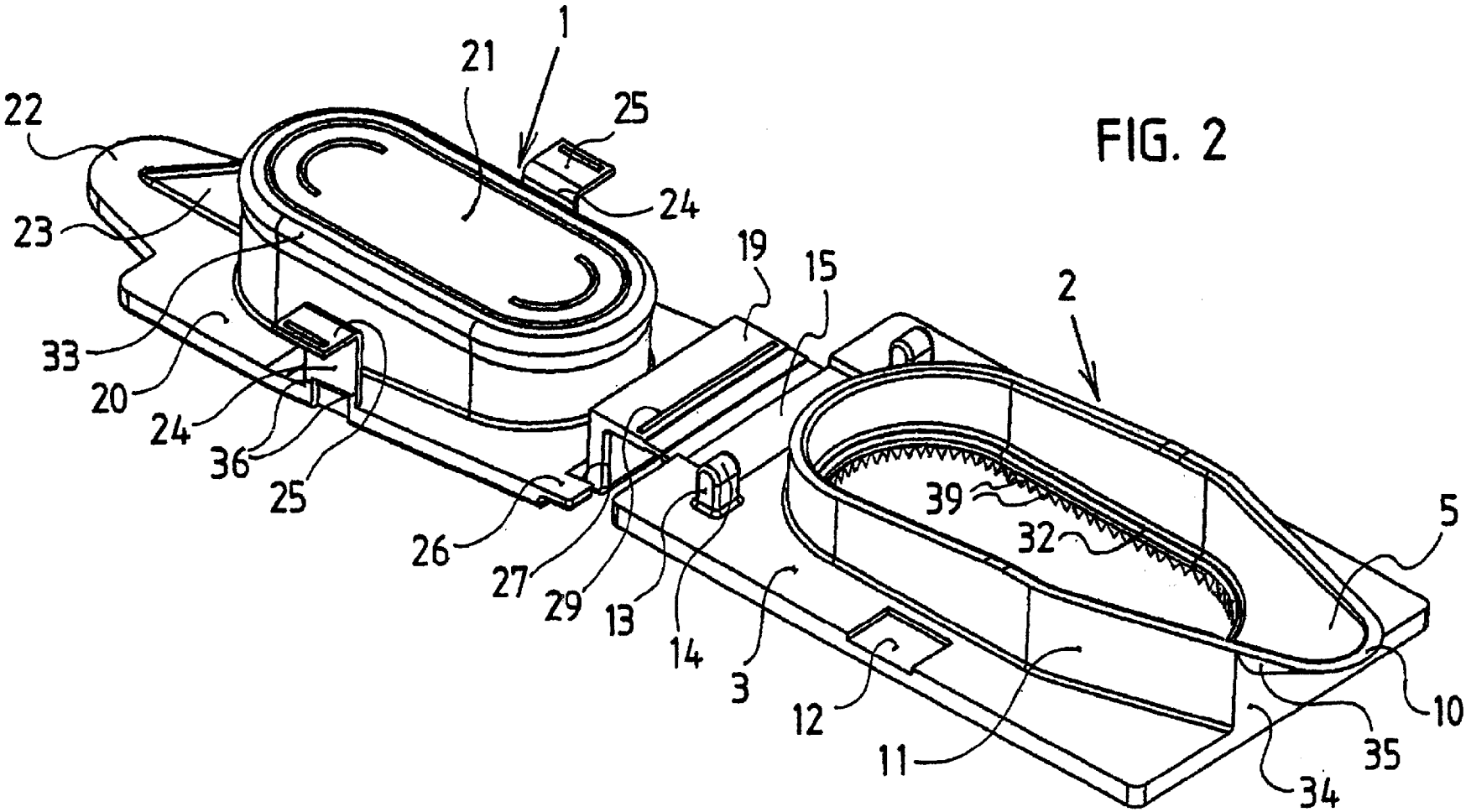

FIG. 2: Shows the open spout lid in a perspective projection with the bottom part in the front and the pertinent lid behind the bottom part.

Figure 3:
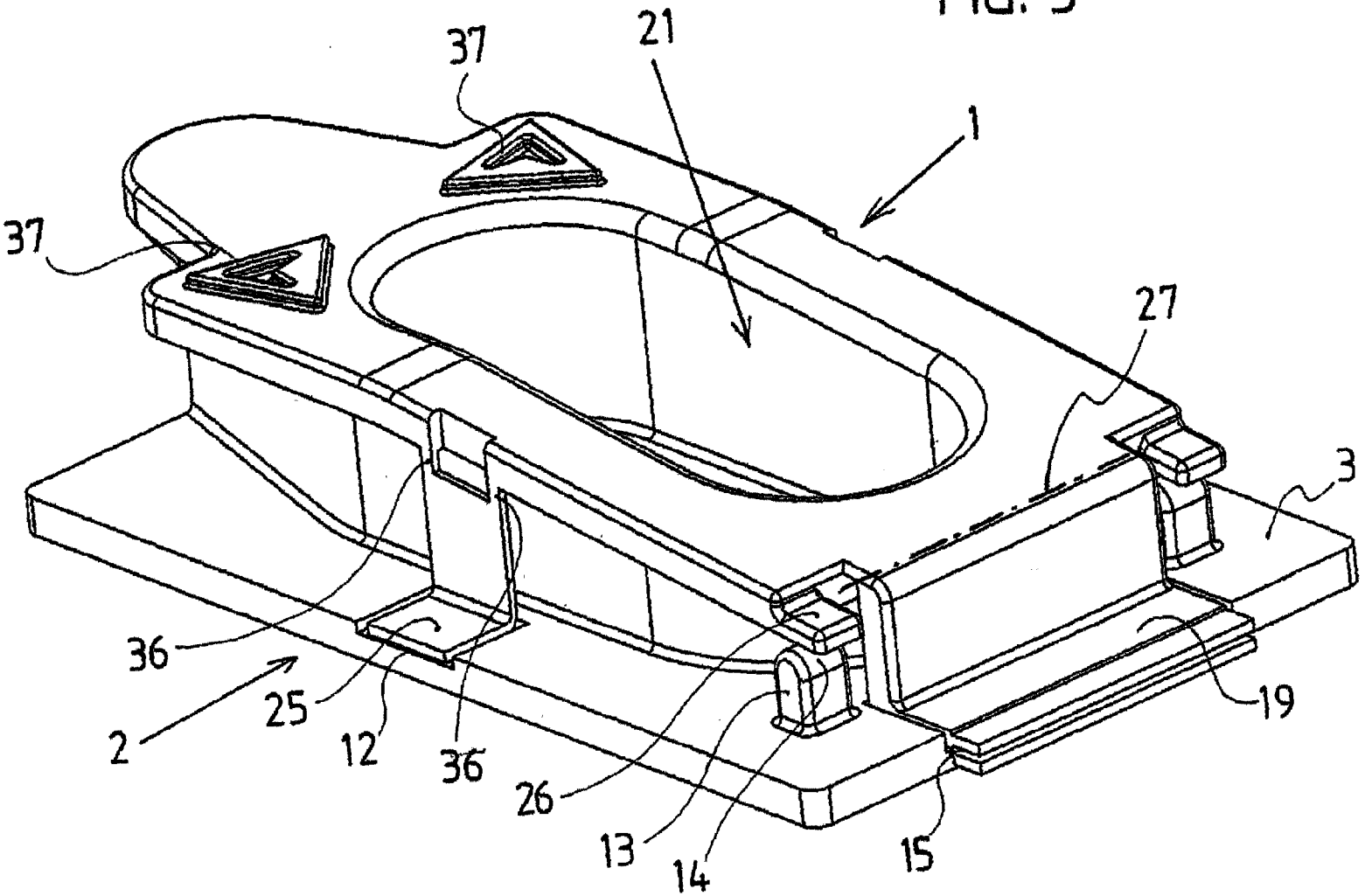

FIG. 3: Shows the closed spout lid in a perspective projection in an oblique view from the back onto the hinge.

Figure 4:
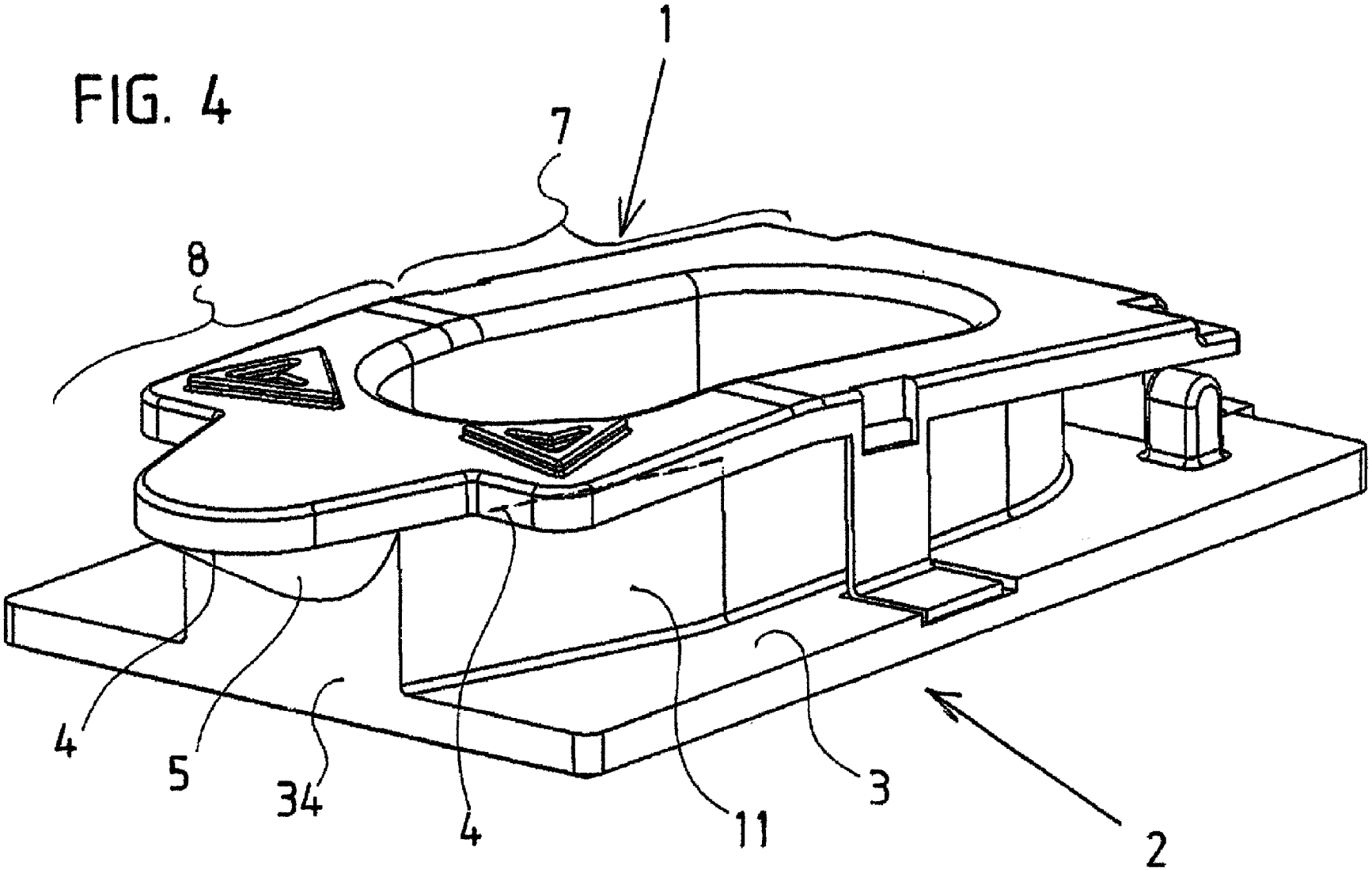

FIG. 4: Shows the closed spout lid in a perspective projection in an oblique view from the front onto the pouring spout.

Figure 5:
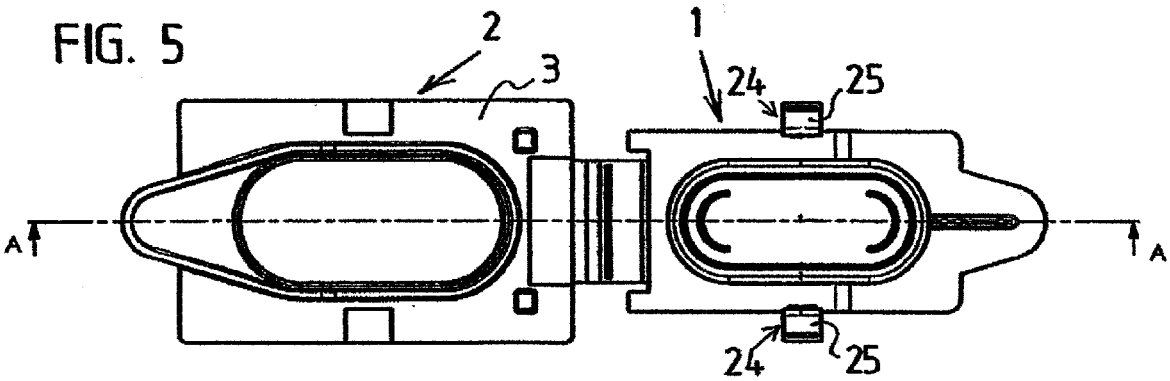

FIG. 5: Shows the open spout lid in a view from the top with a drawn line of intersection A—A.

Figure 6:
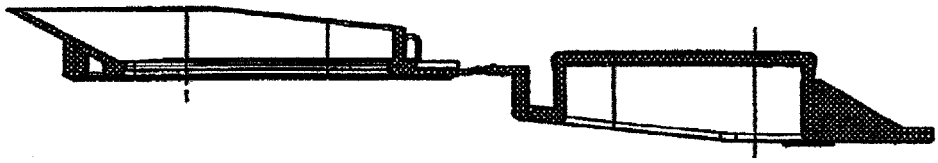

FIG. 6: Shows the open spout lid seen from the side in a sectional view along the line A—A inserted in FIG. 5.

Figure 7:
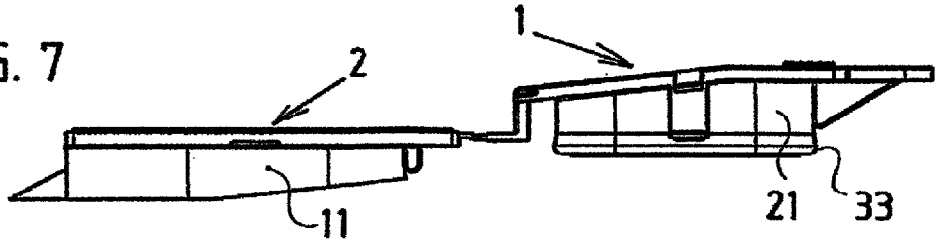

FIG. 7: Shows the open spout lid in a position rotated by 180° compared to the view in FIG. 6, seen from the side.

Figure 8:
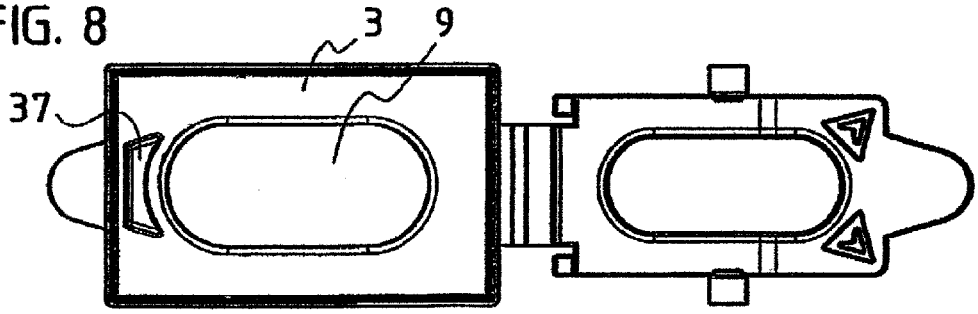

FIG. 8: Shows the open spout lid seen from the bottom.

Figure 9:
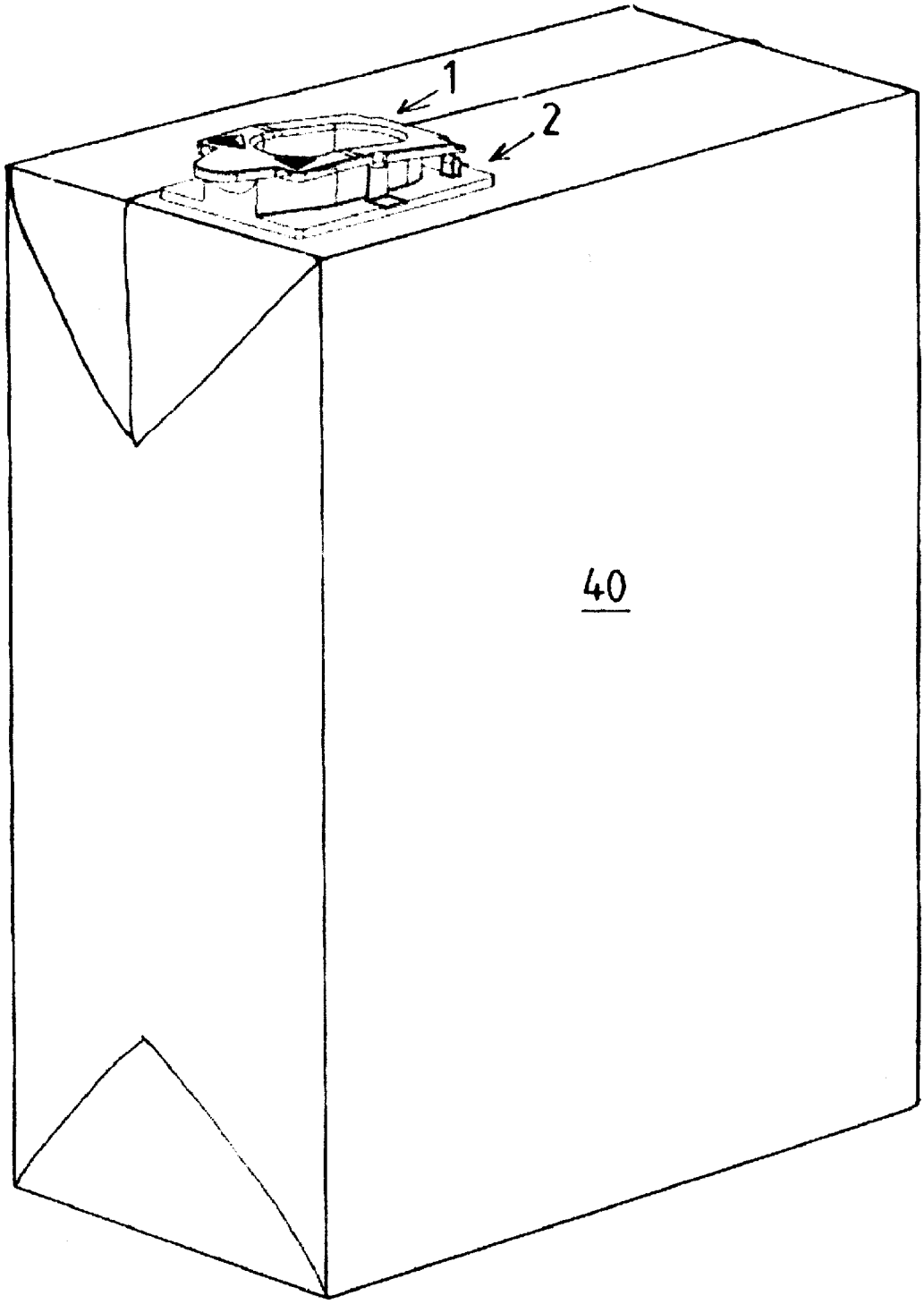

FIG. 9: Shows a prospective view of a combipack having the pouring spout seal of the present invention.

DETAILED DESCRIPTION OF THE DRAWING FIGURES AND PREFERRED EMBODIMENTS

FIG. 1 shows the spout lid in a perspective view. The lid 1 is in the front and the bottom part 2 behind it. This bottom part 2 consists of a level disk 3 onto which an upward-projecting overhang 11 with lip 4 is molded. On the front side of this bottom part 2, which points to the back in this drawing, this is shaped into a pouring spout 5 and therefore has a wall 6, which runs at an oblique angle to disk 3. The overhang 11 rises with its lip 4 with reference to its height opposite disk 3 from the side of the hinge and this continues across section 7, whereby the lip 4 in the front section 8, which forms the spout, then runs level resp. parallel to disk 3. Therefore, the lip 4 is higher in the section 8 of the spout 5 than in the other section 7. The overhang 11 encloses a clearance opening 9 at the height of disk 3, which has the shape of a zero here and has been taken out of disk 3. The inner rim of this opening 9 is advantageously serrated and the teeth protrude downwards as shown below the figure in the enlarged illustration of a section drawn into the figure. The teeth 39 are made of by triangles, which form the vertical or slightly inclined front sides of delta profiles aligned on the bottom side of disk 3 and which protrude outwards from the opening 9. These delta profiles taper towards the back and merge into the level disk 3. They could be aligned in such a way on the bottom side of disk 3 that the bottom tips of the teeth 39 lie flush with the bottom side of disk 3 or that these teeth instead slightly protrude downward from the bottom side of the level disk 3. These teeth form effective tear-open aids with the sharp front edges of the respective delta profile and their downward-projecting tips, which becomes clear in the subsequent description of the seal's function. Close to opening 9 and running parallel to its edge, the bottom edge section of the overhang 11 is equipped with a bulge 32 on its inside. The front lip 10 of the pouring spout 5 is has a particularly sharp shape due to the level and horizontal top lip 4 of the overhang 11 merging with the external wall of the overhang 11 at an acute angle, as shown in other views. This measure ensures that no liquid is sucked up by the outside of spout 5 when pouring, due to its capillarity and the adhesive effect of the plastic material, and runs down the outside of the spout. To the left and the right of overhang 11, one square indentation 12 each is taken out of the top side of disk 3, whose function is demonstrated later on. On the back side of the bottom part 2 facing the observer, one cam 13 each is molded, which protrudes vertically upwards from disk 3 and has a semi-cylindrical end 14 on top. Between this at the back end of bottom part 2, a rectangular indentation 15 is countersunk into the top side of disk 3, whose rear edge is protruded by a lip 16. This lip's outer edge forms a film hinge 17 with another lip 18, which is connected with an L-shaped swivel elbow 19. This swivel elbow 19 is swivel-mounted to lid 1 with its other end via a film hinge 27. Because of the L-shape of the swivel elbow 19, the lid 1 is at a lower level in the open position shown here, in which the pouring spout is molded, than disk 3 of bottom part 2. If the lid 1 is swiveled onto bottom part 2 from the position indicated here around the hinge axis formed by the first film hinge 17, the swivel elbow 19 lies flush in the rectangular indentation 15. After the seal is injection-molded of plastic in the open position shown here, the swivel elbow is firmly fused with this indentation 15 after the joining of both parts 1 and 2. For easier fusing, the leg of the swivel elbow 19 can receive a groove 29, which serves as additional fusing material. This groove 29 can also have an S-shape or several adjoining grooves can be aligned to form fusable material in order to generate a connection capable of withstanding tensile forces. The film hinge 17 only serves for the initial and one-off closing of the seal in the production phase. For subsequent repeat opening via another film hinge, lid 1 can be swiveled via another film hinge away from and towards the bottom part 2, namely the film hinge 27, to which it is connected by the L-shaped swivel elbow 19. The lid part 1, which is visible from the bottom here because it is swiveled away from the bottom part 2, also includes, like bottom part 2, a level disk 20, which is however a bit narrower than disk 3. From this disk 20, an upward protruding tub-shaped bulge 21 that projects upwards with side walls 31, which essentially run perpendicular to disk 20, is shaped. This bulge 21 has such a height adapted to the respective height of the overhang 1 at the bottom part 2 that when this bulge 21 swivels into the clearance opening 9 of the overhang 11, its top side runs parallel to the bottom side of bottom part 1. A collar 33 is molded onto the side wall of the bulge 21 near to its upward protruding lip and runs parallel to the same. When closing lid 1 onto bottom part 2, this collar 33 snaps into the inner edge of overhang 11 below collar 32 and thus seals the two parts 1 and 2. Grooves 28 can be applied to the bottom side of the tub-shaped bulge 21, which are intended for easier fusing of bulge 21 with the sealing foil of the combipack to be equipped with the seal. These grooves 28 contribute additional material that is melted on for fusing. They may also have a different shape for this purpose and may extend over the entire bottom side of bulge 21. On the front of the bulge 21, disk 20 extends to a latch 22 in the front. This latch is connected by a triangular rib 23, which runs perpendicular to disk 20, with the outside of bulge 21 and thus reinforced. On both sides of the tub-shaped bulge, there are L-shaped wings 24 molded to the bottom side of disk 20. The shorter legs 25 of these wings 24 are dimensioned in such a way that when swiveling the lid 1 onto the bottom part 2, they fit into the square indentations 12 in its disk 3, with which they are fused after initial closing. As shown, the bottom sides of the legs 25 can be fitted with one groove 30 each or several grooves, which makes it easier to fuse them with the indentations 12. Also to be mentioned are the two latches 26 which run along the hinge side of the lid 1 in both directions towards the hinge. Due to the swivel geometry as a result of the alignment of the swivel axis 27 of the hinge on lid 1, which is active in operation, these latches 26 run over the semi-cylindrical top sides 14 of the cams 12 on the bottom part 2 when swinging open and close. The cams 13 on bottom part 2 have such a height that the latches 26 have to bend slightly for running over the cams. As a consequence, lid 1 is kept open, i.e. at least at an opening angle of approx. 90° in relation to the bottom part 2.

In FIG. 2, this spout seal is shown open (in the state in which it is molded) in a perspective view with the bottom part 2 in the foreground and the lid 1 behind it. In this view, one sees the pouring spout 5 and, more specifically, that it protrudes forward from the front edge of the level disk 3. Wall 35, which forms the pouring spout 5, has a channeled shape and extends to a sharp edge 10 at its end, so that this is drip-proof and no liquid is sucked onto the outside of wall 35 after pouring and runs down along the same. Once the swivel elbow 19 is fused with indentation 15 after the first and one-off closing of the seal after its production by means of injection molding, the elastic latches 26 interact with the cams 13 by running over their semi-cylindrical top sides 14 when the lid 1 is swiveled open from the bottom part 2 and closed again onto it around the axis of film hinge 27. The two wings 24 on lid 1 are fused with the indentations 12 on disk 3 of bottom part 1 of the seal with their legs 25 when the seal is swiveled shut for the first and only time after its production by means of injection molding. For fusing, the grooves 30 contribute additional melt-on material. Afterwards, the thin spots 36 on these wings 24 act as breaking points and thus form guarantee features. If the seal, which was closed in the factory, with lid 1 fused with bottom part 2 in the above-described way is opened for the first time by the customer, lid 1 must be swiveled open by breaking these thin spots 36 while all three fusings remain intact and therefore film hinge 27 becomes effective for opening and closing lid 1.

FIG. 3 shows the closed spout lid in a perspective projection in an oblique view from the back onto the closed hinge. Lid 1 is swiveled onto bottom part 2 here and fused with this in three places. On the one hand, the lying leg of the swivel elbow 19 on lid 1 is fused with the indentation 15 on disk 3 of the bottom part 2. On the other hand, the legs 25 of the two wings 24 are fused with the indentations 12 in disk 3 of the bottom part 2. In this condition, the spout seal is ready to be fused onto a combipack, whereby the entire bottom side 3 is fused or bonded with the outside of the combipack, and then the bottom side of the tub-shaped bulge 21 is either bonded with the outside of the pre-punched combipack or fused with the exposed sealing foil in the combipack material. The grooves 28 on the bottom side of bulge 21 serve for this fusion and contribute additional material that is fused on in the process, and then merges tightly with the sealing foil. In this position with the two parts 1 and 2 swiveled together, the top side of the tub-shaped bulge, which points downwards now and is not visible, is flush with or slightly deeper than the bottom side of disk 3. When it is flush with the bottom side of disk 3, it is intended to be glued onto the outside of the combipack, which is prepared for this purpose around this area with a sectional pre-punching of the carton. So the carton is punched throughout in the section covered by the bulge, so that a punched-out carton disk is formed, which still remains in its position though and is still tightly connected with the continuous sealing foil, which runs underneath the carton. When lid 1 is then swiveled upwards, this pre-punched carton disk is torn along and tears along the sealing foil fused to it in the punched out section. Especially if the edge of opening 9 is equipped with small sharp teeth 39, a defined hole is reliably torn out of the sealing foil, which creates a clean hole for pouring. In the other case, where the bulge slightly protrudes downward from the bottom side of disk 3, it is intended to lie at the sealing foil exposed by previously punching out the carton, with which it is then fused directly. Grooves 28 serve for this purpose as already mentioned. When first swiveling up the lid 1, the sealing foil is then cleanly torn out in the entire area of the pouring hole 9 in bottom part 2. The effective swivel hinge between lid 1 and bottom part 2 is the one around the hinge axis 27 drawn in as a broken line. To open the lid, one finger is to be used to grab under latch 22 on lid 1 so as to swivel the lid upward. The two markings 37 show the user on which side he has to grab the lid 1 for opening and pull it upwards. When first opening the seal, the thin spots 36 on the wings 24 have to be torn first. These thin spots 36 therefore act as guarantee features. If these are still intact, this guarantees that the seal has never been opened before. If one pulls up lid 1 by breaking these thin spots, its bulge takes along the carton disk bonded to it, or—in the other case—the sealing foil fused to it, and therefore cleanly tears the sealing foil out of the punched out section in the combipack, which completely opens the passage through opening 9 in bottom part 1. Further swiveling of lid 1 after tearing the thin spots 36 and dragging along the sealing foil then takes place around the hinge axis 27, and the two latches 26 are also swiveled around this axis 27 accordingly. In doing so, they touch the top semi-cylindrical ends 14 of the two cams 13, because these cams 13 protrude slightly into their swiveling ranges.

When further swiveling up lid 1, the two latches 26 are bent elastically, so that their tips glide over the semi-cylindrical ends 14 of the cams 13, and when the lid part was swiveled by approx. 90°, the latches 26 jump back to their original position. In this position, they keep the lid 1 open and prevent it swiveling shut again on its own. The once opened spout seal therefore remains securely open and the combipack can be operated single-handedly for pouring. In order to close the seal, lid 1 merely has to be swiveled closed with sufficient force because the latches 26 again have to glide over the semi-cylindrical ends 14 of cams 13 with their tips under renewed elastic deformation and fall back into a strain-free position once they are past them, in which lid 1 is then completely swiveled down onto the bottom part 2, whereby the collar 33 on bulge 21 snaps into place and seals below collar 32 at the inside of the overhang 11.

FIG. 4 shows the closed pouring seal in a perspective projection in an oblique view from the front. One can see how the pouring spout 5 protrudes the front side 34 of disk 3 of bottom part 2 and merges at a sharp angle with the lip 4 of the overhang 11. For added clarity, the course of lip 4 is also indicated in a broken line. In the front section 8, the top part of lid 1 runs parallel to disk 3; in the rear section 7, however, the top part of lid 1 inclines slightly starting from its hinge in relation to disk 3.

FIG. 5 shows the open spout seal in a view seen from the top, whereby an intersection line A—A is additionally drawn in. In this view, it becomes clear that lid 1 is narrower than disk 3 of the bottom part 2 and that the legs 25 of the wings 24 slightly protrude this width.

FIG. 6 displays the open spout seal in a sectional view along the line A—A shown in FIG. 5. This FIG. 6 shows that the lid 1 is, due to the swivel elbow 19, on a lower level than bottom part 2 in a position swiveled up by 180°, in which the entire spout seal is molded.

FIG. 7 shows the open spout seal in a view rotated by 180° in relation to the illustration shown in FIG. 6. Collar 33 at the outside of bulge 21 of lid 1 is clearly visible in this illustration. When closing lid 1 onto bottom part 2, this collar 33 snaps into place behind collar 32, which is not visible here, on the inside of overhang 11 of bottom part 2, so that the spout seal is tightly closed.

FIG. 8 shows the open spout seal from below, i.e. seen from above in a position rotated by 180° lying on a surface. Later on, the bottom side of disk 3 is fused or bonded to the outside of a combipack. Here, the opening 9 in this disk 3 must come to lie on the section punched out down to the sealing foil in the packaging material. There is a marking 37 visible in the front part of disk 3, which is, however, only due to molding as the pouring spout 5 rises above disk 3 and the wall thickness of a molded part is limited.

FIG. 9 shows a prospective view of a combipack (40) having the pouring spout seal of the present invention.

The invention claimed is:

1. A spout seal for a combipack, comprising:

a bottom part fusable onto a combipack with a level bottom side of said bottom part, said bottom side comprising a disk;

a circular upwardly projecting overhang forming a pouring spout with an inner side of said circular upwardly projecting overhang being open;

an L-shaped moving-along swivel arm comprising a first leg and a second leg;

a first film hinge;

a second film hinge; and, a lid molded onto said bottom part for swiveling upwardly via said first film hinge and downwardly onto said bottom part for sealing, said lid forming a mold bulging upwardly, when open, for forming a level upper surface, thereby of form-fitting into a clearance opening in said level bottom side of said bottom part and surrounded by a projecting lip when said lid is closed and flush with said bottom side or projecting downwardly therefrom by up to 0.5 mm, said lid being connected via said first film hinge to said L-shaped moving-along swivel arm by which said lid is connected to said bottom part via said second film hinge, so that said first leg of said L-shaped, moving-along swivel arm facing said bottom part is fusable with said disk forming said bottom side of said bottom part when said lid is swiveled shut for an initial time and an edge of said second leg of said L-shaped moving-along swivel arm forming a swivel axis for swiveling said lid onto, and off of, said bottom part.

2. The spout seal for a combipack according to claim 1, further comprising an L-shaped wing having breaking points molded onto a bottom side of said lid, said L-shaped wing having a free leg fusable with said disk forming said bottom side of said bottom part.

3. The spout seal for a combipack according to claim 2, further comprising notches at a top side of said disk of said bottom part for an uptake of said first leg of said L-shaped moving-along swivel arm facing said bottom part and said free leg of said L-shaped wing at said lid, and further including grooves at an outer side of said mold bulging upwardly at said lid for fusing said outer side with a sealing foil of said combipack.

4. The spout seal for a combipack according to claim 2, wherein said lid is narrower than said bottom part with said free leg of said L-shaped wing protruding a width of said lid.

5. The spout seal for a combipack according to claim 1, further comprising:

an elastic latch formed to said bottom part of said lid on both sides of said first film hinge with said elastic latch running along a bottom side of said lid towards said bottom part of the seal; and, a cam having a semi-cylindrical top end formed onto a top side of said disk forming said bottom side of said bottom part, said cam projecting in a vertical direction from said disk, so that a tip of said elastic latch is able to glide over said semi-cylindrical top end of said cam under elastic deformation due to swivel geometry.

6. The spout seal for a combipack according to claim 1, wherein said circular upwardly projecting overhang at said bottom part initially rises in height, starting from a hinge side, and has a constant height in a section of said pouring spout, wherein a wall of said circular upwardly projecting overhang runs, on a front side, at an oblique angle to said disk for forming said pouring spout, which projects from said front side of said disk toward the front side, said circular upwardly projecting overhang further including an acute angle on an outer side of top lip of said pouring spout with said mold bulging upwardly having a height and shape wherein a top side of said mold bulging upwardly runs parallel to said bottom side of said bottom part, when closed.

7. The spout seal for a combipack according to claim 1, further comprising:

a first collar formed onto a side wall of said mold bulging upwardly near a top edge of said mold and running parallel thereto; and, a second collar formed on said inner side of said circular upwardly projecting overhang on said bottom part and parallel to an edge of said bottom part running along side said disk, wherein said first collar on said lid snaps shut on said bottom part behind said first collar at said circular upwardly projecting overhang when closing said lid.

8. The spout seal for a coinbipack according to claim 1, further comprising:

a grip latch formed on said lid in front of said mold bulging upwardly and connected with an outer side of said mold bulging upwardly via a triangular rib running in a rectangular direction to said grip latch.

9. The spout seal for a combipack according to claim 1, wherein said clearance opening has a lip fitted with sharp teeth projecting downwardly.

* * * * *